US007112097B1

(12) United States Patent
Lam

(10) Patent No.: US 7,112,097 B1
(45) Date of Patent: Sep. 26, 2006

(54) COMPACT ELECTRICAL POWER OUTLET SYSTEM

(76) Inventor: Khanh Lam, 10513 E. Fieldcrest St., El Monte, CA (US) 91731

( * ) Notice: Subject to any disclaimer, the term of this patent is extended or adjusted under 35 U.S.C. 154(b) by 0 days.

(21) Appl. No.: 11/180,016

(22) Filed: Jul. 12, 2005

(51) Int. Cl.

| | |
|---|---|
| ***H01R 25/00*** | (2006.01) |
| ***H01R 27/02*** | (2006.01) |
| ***H01R 31/00*** | (2006.01) |
| ***H01R 33/92*** | (2006.01) |
| ***H01R 33/94*** | (2006.01) |

(52) U.S. Cl. ..... 439/654

(58) Field of Classification Search ..... 439/654, 439/652, 651, 650, 638–639, 214, 490
See application file for complete search history.

(56) References Cited

U.S. PATENT DOCUMENTS

| | | | | |
|---|---|---|---|---|
| 1,597,437 | A * | 8/1926 | De Reamer | 200/51.02 |
| 4,867,701 | A | 9/1989 | Wiand | |
| D409,980 | S | 5/1999 | Byrne | |
| D432,499 | S | 10/2000 | Stekelenburg | |
| D446,503 | S | 8/2001 | Lee | |
| D452,215 | S | 12/2001 | Stekelenburg | |
| D458,225 | S | 6/2002 | Stekelenburg | |
| D459,307 | S | 6/2002 | Nieto | |
| 6,399,910 | B1 * | 6/2002 | Crawford et al. | 200/405 |
| D481,357 | S | 10/2003 | Stekelenburg | |
| D484,099 | S | 12/2003 | Bettencourt | |
| D490,777 | S | 6/2004 | Yu | |
| D493,426 | S | 7/2004 | Strayer | |
| 2003/0228803 | A1 * | 12/2003 | Toering | 439/652 |

OTHER PUBLICATIONS 4 pages of product description and information about power strips sold on www.tripplite.com, date printed Jun. 21, 2005.
1 web page owned by Kensington Technology Group, www.Kensington.Com, titled Smartsockets Table Top, Aug. 23, 2005.

* cited by examiner

*Primary Examiner*—Javaid H. Nasri
(74) *Attorney, Agent, or Firm*—Eric Karich

(57) ABSTRACT

A compact electrical power outlet system includes a base, multiple electrical receptacles adapted to receive an electrical plug, a power input for receiving electrical power, and an electrical system including a power switch. A movable cover mounted on a top surface of the base is adapted to cover the power switch. The electrical system is adapted to provide the electrical power received via the power input to each of the electrical receptacles when the power switch is in an on position.

1 Claim, 3 Drawing Sheets

COMPACT ELECTRICAL POWER OUTLET SYSTEM

CROSS-REFERENCE TO RELATED APPLICATIONS

Not Applicable

STATEMENT REGARDING FEDERALLY SPONSORED RESEARCH

Not Applicable

BACKGROUND OF THE INVENTION

1. Field of the Invention

This invention relates generally to electrical power distribution devices, and more particularly to a compact electrical power outlet system.

2. Description of Related Art

In general, an electrical power distribution device (commonly called a "power strip") is an electrical device used to supply electrical power from a single electrical outlet (i.e., receptacle) to multiple electrical devices. Unlike common extension cords, power strips usually have on/off switches for controlling electrical power to several electrical receptacles. The electrical receptacles of power strips typically include ground terminals in addition to hot and neutral terminals. Many power strips also have power indicators and/or circuit breakers that can be reset after an overload.

Many modern devices receive electrical power via plug-in power supplies with bodies having integral electrical plugs. For example, portable devices such as cellular telephones, digital cameras, digital audio players, and personal digital assistants (PDAs) typically have batteries that are charged via such plug-in power supplies. Computer system devices such as modems, printers, external drives, and speaker systems often receive electrical power via such plug-in power supplies.

Most known power strips are rectangular in shape and have several electrical receptacles along one or more sides. In order to accommodate bodies of common plug-in power supplies with integral electrical plugs, the electrical receptacles are often spaced apart from one another. Generally speaking, power strips with several electrical receptacles spaced apart are long and large in size. It would be advantageous to have a power strip that is relatively compact and small in size yet provides several electrical receptacles each able to accommodate a body of a plug-in power supply with an integral electrical plug.

SUMMARY OF THE INVENTION

A compact electrical power outlet system includes a base having opposed top and bottom surfaces and a side surface extending between the top and bottom surfaces. A plurality of electrical receptacles are mounted in the side surface of the base, and each of the electrical receptacles is adapted to receive an electrical plug. A power input is adapted for receiving electrical power. An electrical system includes a power switch mounted in the top surface of the base, wherein the electrical system is adapted to provide the electrical power received via the power input to each of the electrical receptacles when the power switch is in an on position. A movable cover is adapted to cover the power switch.

A primary objective of the present invention is to provide a compact electrical power outlet system having advantages not taught by the prior art.

Another objective is to provide a compact electrical power outlet system with a power switch mounted on a hold-down knob extending upwardly from a top surface.

Another objective is to provide a movable cover mounted on the top surface to prevent a power switch from being inadvertently turned on or off, and to provide a hold-down point for facilitating removal of the electrical plugs.

Another objective is to provide a cover that transmits at least some of the light emitted from the power switch.

A further objective is to provide a compact electrical power outlet system having a circular ground conductor, a circular neutral conductor, and a circular hot conductor.

Other features and advantages of the present invention will become apparent from the following more detailed description, taken in conjunction with the accompanying drawings, which illustrate, by way of example, the principles of the invention.

BRIEF DESCRIPTION OF THE DRAWING

The accompanying drawings illustrate the present invention. In such drawings.

DETAILED DESCRIPTION OF THE INVENTION

Figure 1:
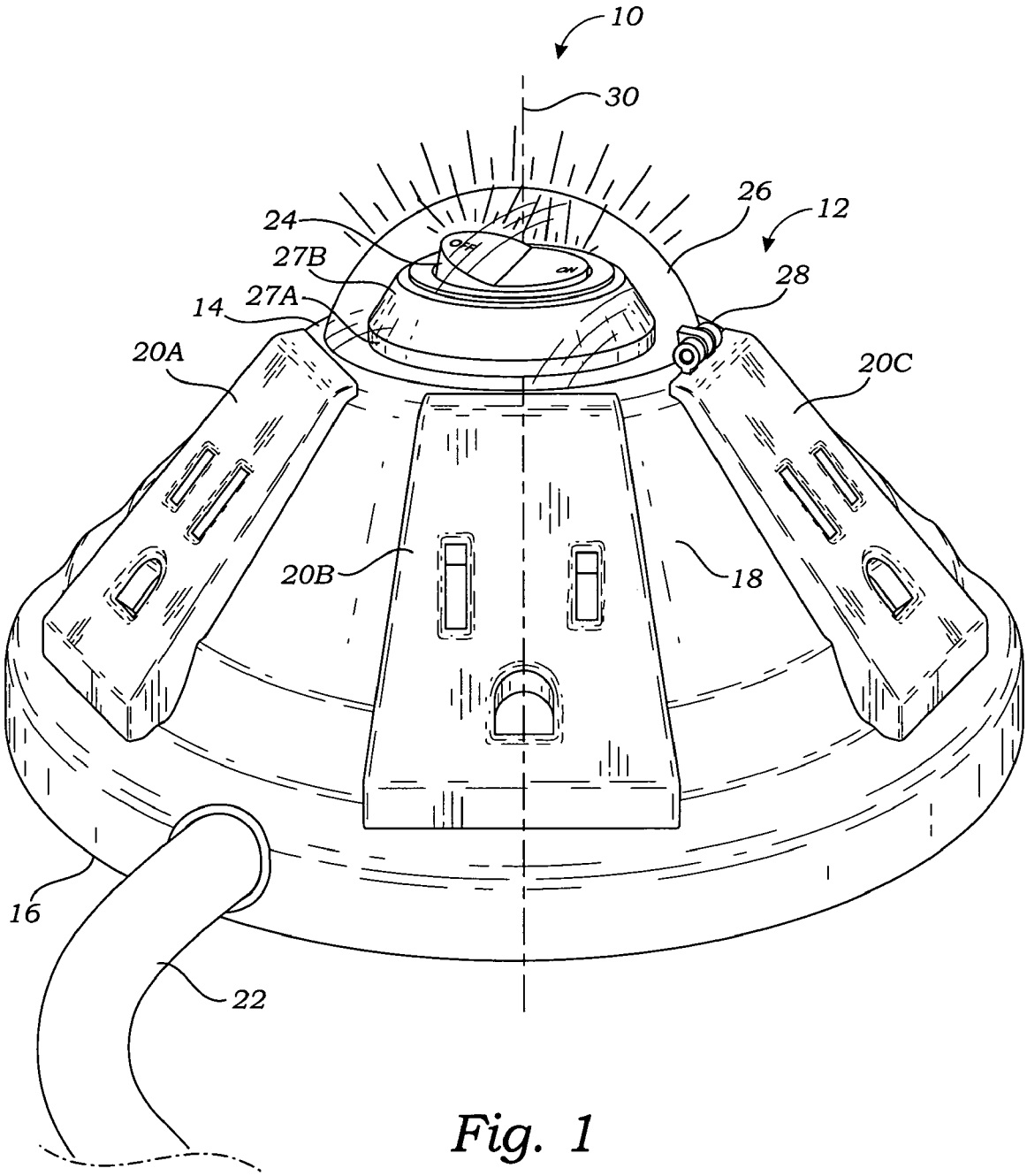
FIG. 1 is a perspective view of one embodiment of a compact electrical power outlet system including a base and multiple electrical receptacles mounted in a side surface of the base.

FIG. 1 is a perspective view of one embodiment of a compact electrical power outlet system 10 including a base 12 and multiple electrical receptacles mounted in a side surface 18 of the base. The compact electrical power outlet system 10 of FIG. 1 is relatively small in size, yet advantageously provides several electrical receptacles each able to accommodate a body of a plug-in power supply with an integral electrical plug.

In the embodiment of FIG. 1, the base 12 has a top surface 14 and an opposed bottom surface 16, and the side surface 18 extends between the top surface 14 and the bottom surface 16. The top surface 14 and the bottom surface 16 of the base 12 are substantially round in shape, and the side surface 18 is curved. The compact electrical power outlet system 10 includes 6 electrical receptacles mounted in the side surface 18, 3 of which are visible in FIG. 1 and labeled 20A–20C. Herein below, the 6 electrical receptacles of the compact electrical power outlet system 10 will be referred to collectively as the electrical receptacles 20. Each of the electrical receptacles 20 is adapted to receive an electrical plug.

In the embodiment of FIG. 1, the compact electrical power outlet system 10 also includes a power input 22 for receiving electrical power. In the present embodiment, the power input 22 is an electrical power cord. In alternative embodiments, the power input 22 could also be a plug for directly plugging into a wall socket (not shown), it could be wired directly into a wall, or otherwise attached to a power source. As is typical, one end of the power input 22 is connected to the base 12, and the other end of the power input 22 has an attached electrical plug.

In the embodiment of FIG. 1, the compact electrical power outlet system 10 also includes an electrical system having a power switch 24 mounted in the top surface 14 of the base 12. In FIG. 1 the power switch 24 is shown in an on position. In general, the electrical system is adapted to provide the electrical power received via the power input 22 to each of the electrical receptacles 20 when the power switch 24 is in the on position of FIG. 1.

In general, the compact electrical power outlet system 10 also includes a movable cover 26 adapted to cover the power switch 24. In the embodiment of FIG. 1, the cover 26 is attached to the base 12, preferably via a hinge 28 adjacent the power switch 24. Although preferably attached to the base 12, the cover 26 may not be attached to the base 12 in other embodiments. Further, other ways of attaching the cover 26 to the base 12 are possible and contemplated.

The cover 26 is preferably hemispherical in shape, and is preferably attached to the top surface 14 of the base 12, surrounded by the electrical receptacles 20, thereby being positioned to provide a hold-down point to assist in removing the plurality of electrical plugs from the compact electrical power outlet system 10. When the cover 26 is closed, a user may press down upon the cover 26 while pulling up on one of the electrical plugs, thereby holding the compact electrical power outlet system 10 in place and facilitating removal of the electrical plug.

In the embodiment of FIG. 1, the power switch 24 is adapted to emit light when electrical power is received via the power input 22, and the cover 26 is adapted to transmit at least a portion of the light produced by the power switch 24, such that the power switch 24 is easy to locate in the dark. The cover 26 may be, for example, transparent or translucent to the light produced by the power switch 24.

In FIG. 1 the cover 26 is in a closed position about the power switch 24, and the power switch 24 is not accessible. In the closed position of FIG. 1, the cover 26 prevents the power switch 24 from being inadvertently transitioned from the on position of FIG. 1 to an off position.

As described above, in the embodiment of FIG. 1 the top surface 14 and the bottom surface 16 of the base 12 are substantially round in shape, and the side surface 18 is curved. The bottom surface 16 has an area that is larger than an area of the top surface 14, and the side surface 18 substantially resembles a portion of a cone. The base 12 has a central axis 30 extending through the top surface 14 and the bottom surface 16, and the base 12 is substantially symmetrical about the central axis 30. Due mainly to the radial arrangement of the electrical receptacles 20 about the central axis 30, each of the electrical receptacles 20 is able to accommodate a body of a plug-in power supply with an integral electrical plug.

Figure 2:
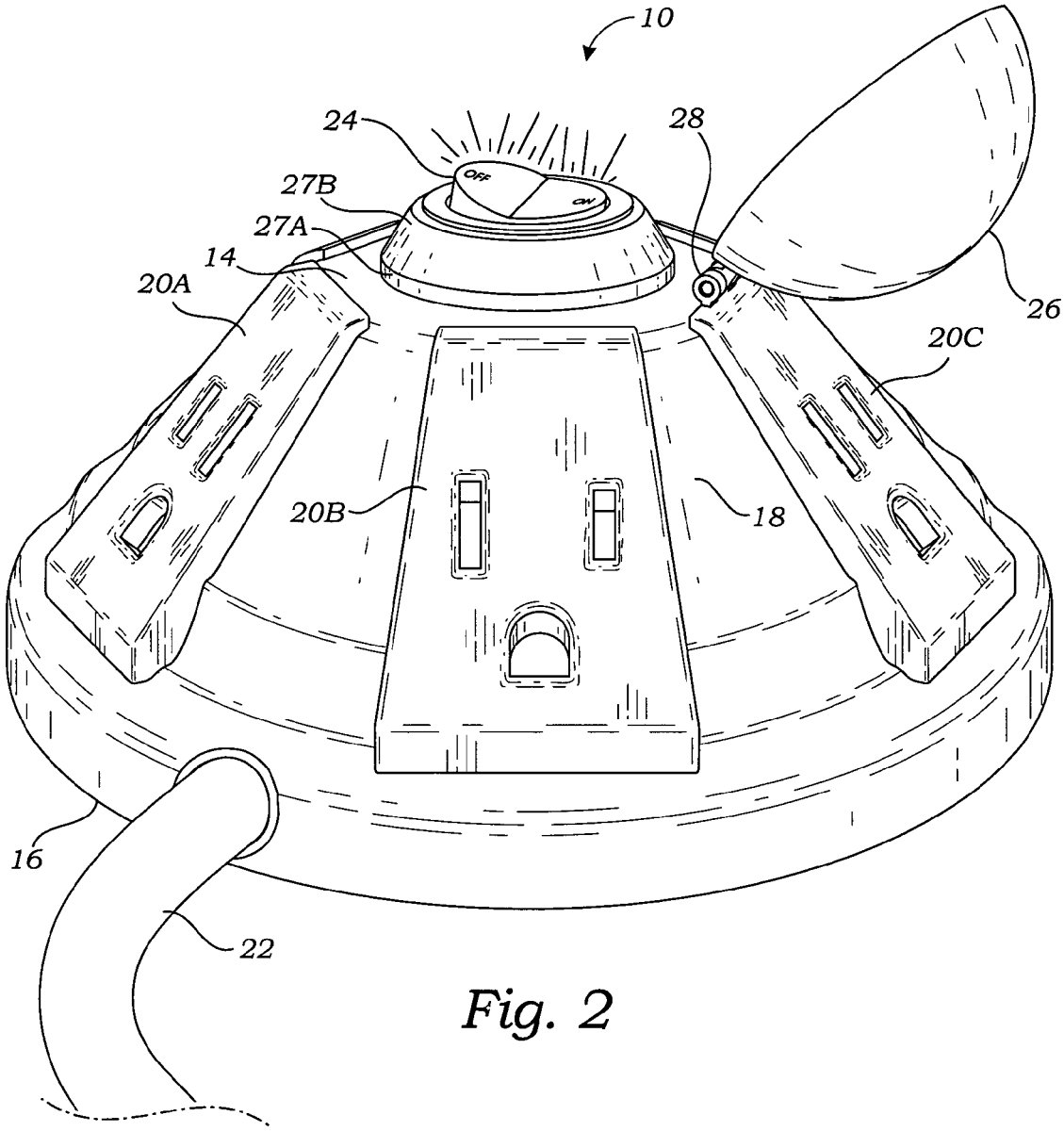
FIG. 2 is a perspective view of the compact electrical power outlet system of FIG. 1 wherein a cover of the compact electrical power outlet system is in an open position and a power switch is accessible.

FIG. 2 is a perspective view of the compact electrical power outlet system 10 of FIG. 1 wherein the cover 26 is in an open position and the power switch 24 is accessible. The power switch 24 is operated by first transitioning the cover 26 from the closed position of FIG. 1 to the open position of FIG. 2 (i.e., by first opening the cover 26).

As shown in FIG. 2, the compact electrical power outlet system 10 preferably includes a hold-down knob 27A extending upwardly from the top surface 14 to form an annular knob shoulder 27B operably positioned above the plurality of electrical receptacles 20 (20A, 2B, 20C) so that pressing downwardly on the annular knob shoulder 27B facilitates removal of the electrical plugs from the electrical receptacles 20. In use, the user can press down on the annular knob shoulder 27B while pulling up on one of the electrical plugs, thus holding the compact electrical power outlet system 10 in place.

The power switch 24 is preferably located on the hold-down knob 27A, surrounded by the annular knob shoulder 27B. The cover 26 can be moved to cover the power switch 24, and preferably the hold-down knob 27A as well, and thus the cover 26 can also provide a hold-down point as well.

Figure 3:
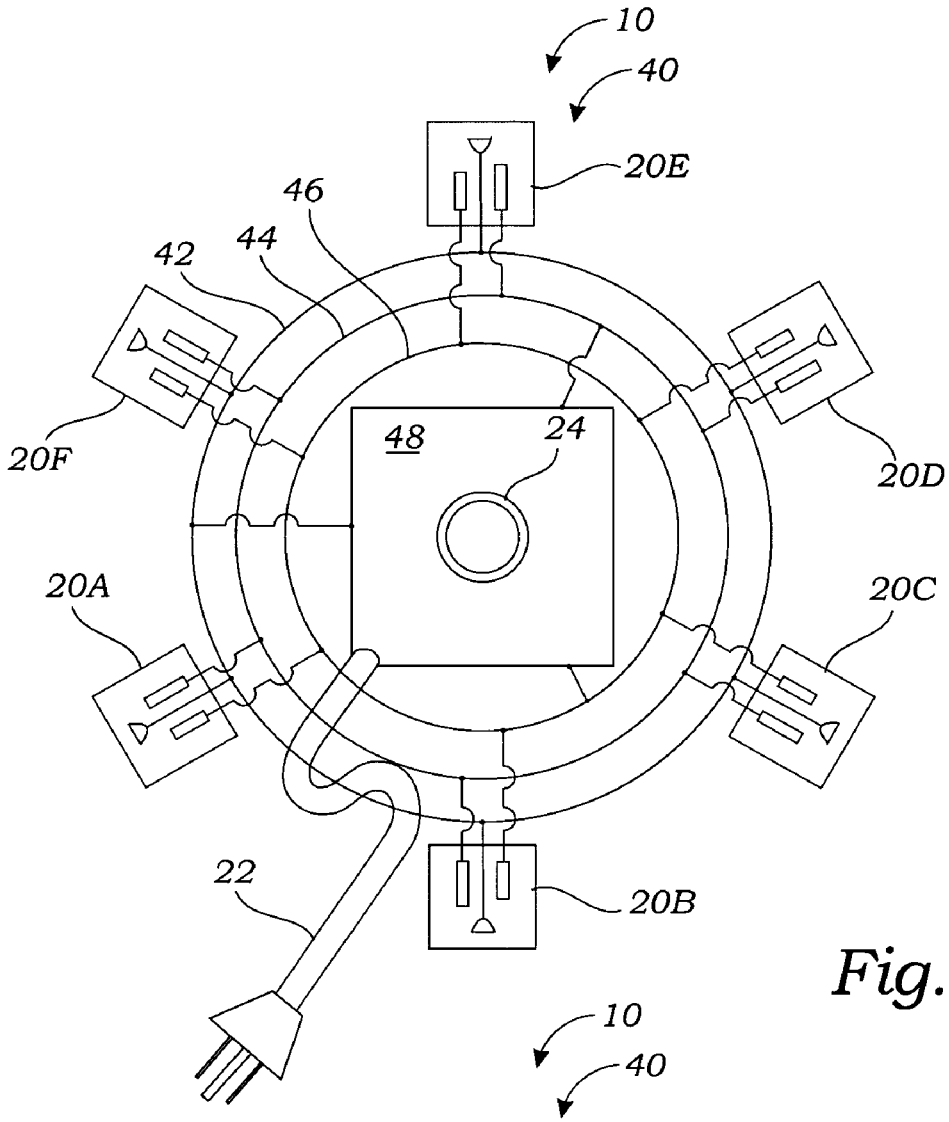
FIG. 3 is a top plan view of one embodiment of an electrical system of the compact electrical power outlet system of FIG. 1.

FIG. 3 is a view of one embodiment of the electrical system, labeled 40, of the compact electrical power outlet system 10 of FIG. 1 as seen from above the compact electrical power outlet system 10. As described above, the electrical system 40 is adapted to provide the electrical power received via the power input 22 to each of the electrical receptacles 20 when the power switch 24 is in the on position. In the embodiment of FIG. 3, the electrical system 40 includes a circular ground conductor 42, a circular neutral conductor 44, a circular hot conductor 46, and a circuit board 48.

All 6 electrical receptacles of the compact electrical power outlet system 10 are visible in FIG. 3 and labeled 20A–20F. As indicated in FIG. 3, the circular ground conductor 42 is connected between the circuit board 48 and a ground terminal of each of the electrical receptacles 20. The circular neutral conductor 44 is connected between the circuit board 48 and a neutral terminal of each of the electrical receptacles 20, and the circular hot conductor 46 is connected between the circuit board 48 and a hot terminal of each of the electrical receptacles 20. The circuit board 48 has trace conductors (i.e., traces) connected to the power input 22 and to the power switch 24. When the power switch 24 is in the on position, the circuit board 48 provides the electrical power received via the power input 22 to the circular conductors 42, 44, and 46, and the circular conductors 42, 44, and 46 provide the electrical power to the electrical receptacles 20.

Figure 4:
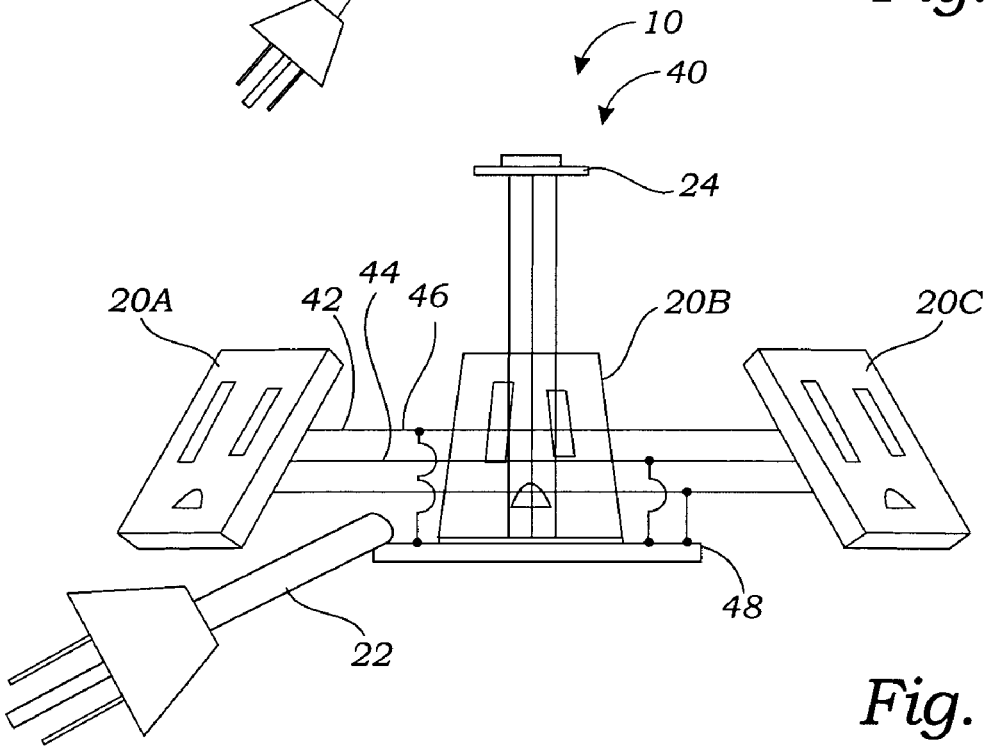
FIG. 4 is a side elevational view thereof.

FIG. 4 is a view of the electrical system 40 of FIG. 3 as seen from a side of the compact electrical power outlet system 10. In FIG. 4, as in FIG. 1, only electrical receptacles 20A–20C of the 6 electrical receptacles 20 are visible. As shown in FIG. 4, the circular ground conductor 42, the circular neutral conductor 44, and the circular hot conductor 46 are positioned in a stacked arrangement within the base 12 of the compact electrical power outlet system 10 (see FIG. 1).

While the invention has been described with reference to at least one preferred embodiment, it is to be clearly understood by those skilled in the art that the invention is not limited thereto. Rather, the scope of the invention is to be interpreted only in conjunction with the appended claims.

What is claimed is:

1. A compact electrical power outlet system adapted to receive a plurality of electrical plugs, the compact electrical power outlet system comprising:

a base having opposed top and bottom surfaces and a side surface extending between the top and bottom surfaces, wherein the top surface and the side surface substantially resembles a portion of a cone;

a plurality of electrical receptacles mounted in the side surface of the base, wherein each of the electrical receptacles is adapted to receive one of the plurality of electrical plugs;

a power input for receiving electrical power;

an electrical system comprising a power switch mounted on the top surface of the base, wherein the electrical system is adapted to provide the electrical power received via the power input to each of the electrical receptacles, via a circular ground conductor, a circular neutral conductor, a circular hot conductor, when the power switch is in an on position;

wherein the power switch is located on a hold-down knob surrounded by an annular knob shoulder and wherein the power switch is adapted to emit light when electrical power is received via the power input; and a movable cover adapted to cover the power switch, wherein the cover is hingedly attached to the base, and wherein the cover is adapted to transmit at least a portion of the light produced by the power switch.

* * * * *